US005855181A

United States Patent [19]

Oxford

[11] Patent Number: 5,855,181

[45] Date of Patent: Jan. 5, 1999

[54] FIXED SHANK PLOW ANCHOR

[76] Inventor: Sefton M.D. Oxford, 1609 S. Central Ave., Kent, Wash. 98032

[21] Appl. No.: 800,273

[22] Filed: Feb. 14, 1997

[51] Int. Cl.[6] ..... B63B 21/32

[52] U.S. Cl. ..... 114/301; 114/310

[58] Field of Search ..... 114/294, 301–304, 114/305, 306

[56] References Cited

U.S. PATENT DOCUMENTS 2,696,187 12/1954 Pitzipio ..... 114/306

5,138,967 8/1992 McCarron et al. ..... 114/301

5,511,506 4/1996 Bruce ..... 114/301

*Primary Examiner*—Jesus D. Sotelo

*Attorney, Agent, or Firm*—H. Jay Spiegel

[57] ABSTRACT

A fixed shank plow anchor includes a weighted nose having a spike incorporated into it to enhance deployment of the anchor on the sea bed. The center of gravity of the anchor is situated within the shank so that when the anchor drops onto a sea bed, and force is applied to the end of the shank in a forward direction, an overturning moment is created facilitating digging of the nose of the anchor into the sea bed. The anchor is self-launching.

9 Claims, 5 Drawing Sheets

FIXED SHANK PLOW ANCHOR

BACKGROUND OF THE INVENTION

The present invention relates to an improved fixed shank plow anchor. While fixed shank plow anchors are known per se, Applicant is unaware of any such anchor including all of the features and aspects of the present invention. The following prior art is known to Applicant:

U.S. Pat. No. 1,974,933 to Taylor discloses a plow-type anchor having a shank and a plow pivotably connected together. Taylor discloses that the center of gravity of the anchor is well forward of a line between the hinge and the rear end of either blade. However, Taylor does not specify particularly where the center of gravity is to be located. In fact, it would be impossible for the center of gravity of the Taylor anchor to be rearward of the specified line. In contrast, the present invention contemplates specifically locating the center of gravity of the anchor within the shank and particularly specifies use of a fixed shank with no pivotable relation between the shank and plow. Furthermore, the present invention contemplates the use of a nose weight having a spike or fin mounted at the front edge of the plow.

U.S. Pat. No. 2,507,563 to Farren discloses a folding plow anchor having a hinged connection between the shank and the plow. The present invention differs from the teachings of Farren as contemplating a fixed connection between the shank and the plow and other features as will be described in greater detail hereinafter.

U.S. Pat. No. 4,397,256 to Bruce discloses an anchor having symmetric flukes and, in one embodiment, a fixed connection between the shank and the flukes. Bruce fails to disclose the particular contemplated center of gravity of his anchor nor does he disclose other features of the present invention including the use of a spike or fin at the forward end of a plow.

U.S. Pat. No. 4,602,588 to MacLean discloses an anchor having a shank generally perpendicular to the flukes and including a central opening between the flukes. The present invention differs from the teachings of MacLean as contemplating a shank fixedly connected to a fluke at a shallow acute angle.

U.S. Pat. No. 4,676,184 to Ogg discloses a flexible shank anchor. In the sole embodiment disclosed in a plow-type fluke, Ogg discloses a pivotable connection between the shank and the fluke.

U.S. Pat. No. 5,138,967 to McCarron et al. discloses a marine anchor having a shank fixedly connected to the fluke and a center of gravity between the fluke and the shank and forward of the connection therebetween. In contrast, in the present invention, the center of gravity of the inventive anchor is located within the shank.

U.S. Pat. No. 5,188,055 to Kershner discloses an adjustable boat anchor having a shank fixedly connected to a fluke and with a slot in the shank allowing sliding of the connection to the shank along the length thereof. Kershner discloses a chamber designed to be filled with a weighted material to allow adjustment of the weight and center of gravity of the anchor. In contrast, in the present invention, the center of gravity is specified as being located within the shank in the connection between the shank and the fluke and the present invention includes the further provision of a spike located centrally of the fluke and at the forward end thereof.

British Patent Specification 2 035 242 to Smith discloses an anchor not of the ploughshare type and having a center of gravity located between the shank and the fluke forwardly of the connection therebetween. In contrast, the present invention contemplates a plow-type anchor having a fixed connection between the shank and the fluke and a center of gravity located within the shank in the connection between the shank and the fluke.

SUMMARY OF THE INVENTION

The present invention relates to an improved fixed shank plow anchor. The present invention includes the following interrelated objects, aspects and features:

(1) In a first aspect, the inventive anchor is of the type having a double-bladed ploughshare-type fluke, also known as a plow-type fluke. The fluke is directly connected to the shank in a fixed manner so that no relative movement between the shank and the fluke is possible.

(2) The shank is generally L-shaped having a forward end with an opening allowing attachment to the appropriate rode. The shank extends in a generally straight line rearward from the attachment point and then curves downwardly to a point of connection with the top of the central axis of the fluke. In the preferred embodiment, the vertical dimension of the shank increases in the direction from the forward termination point thereof to the rearward connection to the fluke.

(3) In the preferred embodiment, the center of gravity of the anchor is located within the shank in the area defined as that which connects the straight portion of the shank with the top of the fluke, namely, the connecting section of the shank. The center of gravity is so located to enable the anchor to quickly deploy itself as soon as force is applied to the forward end of the shank in a forward direction with the anchor lying on the sea bed. The position of the center of gravity causes the nose of the fluke to dig into the sea bed to best facilitate burying of the anchor therein.

(4) In the preferred embodiment, the forward nose of the fluke has a spike or fin vertically extending along the central axis of the fluke. This spike or fin preferably has an arcuate top edge that tapers to a point at the forward end of the fluke. This spike or fin assists the anchor in digging into the sea bed while also maintaining linear digging movement due to the guiding feature of the spike or fin. The spike or fin may also be termed a "dorsal fin".

(5) Many ploughshare-type anchors include a stabilizing bar between the rear ends of the two fluke blades. Such a bar has been omitted in the present invention because the bar interferes with efficient digging of the fluke into the sea bed.

(6) Applicant has tested the inventive anchor and has found that, in sea bed conditions consisting of sandy, rocky and medium to hard clay, the anchor will bury itself within a linear distance of 18" to 2 feet.

As such, it is a first object of the present invention to provide an improved fixed shank plow anchor.

It is a further object of the present invention to provide such an anchor having a center of gravity in the fixed shank at the connection point between the elongated portion of the shank and the fluke.

It is a still further object of the present invention to provide such an anchor having a spike or fin at the forward end of the fluke along the central axis thereof.

It is a still further object of the present invention to provide such an anchor without the need for a stabilizing bar and with enhanced performance as a result of omission of a stabilizing bar.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
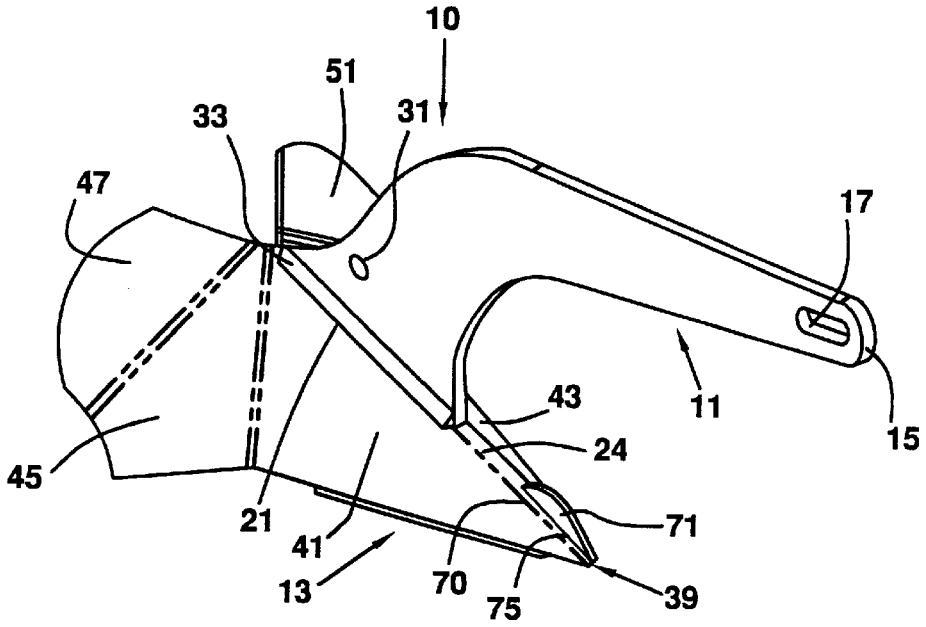
FIG. 1 shows a top side perspective view of the present invention.

With reference to the figures, the present invention is generally designated by the reference numeral 10 and is seen to include an L-shaped shank 11 and a ploughshare or plow-type fluke 13. The shank includes a forward end 15 having a slot 17 therein designed to receive a coupling for anchor rode (not shown) that is to be attached to a vessel deploying the inventive anchor 10.

Figure 6:
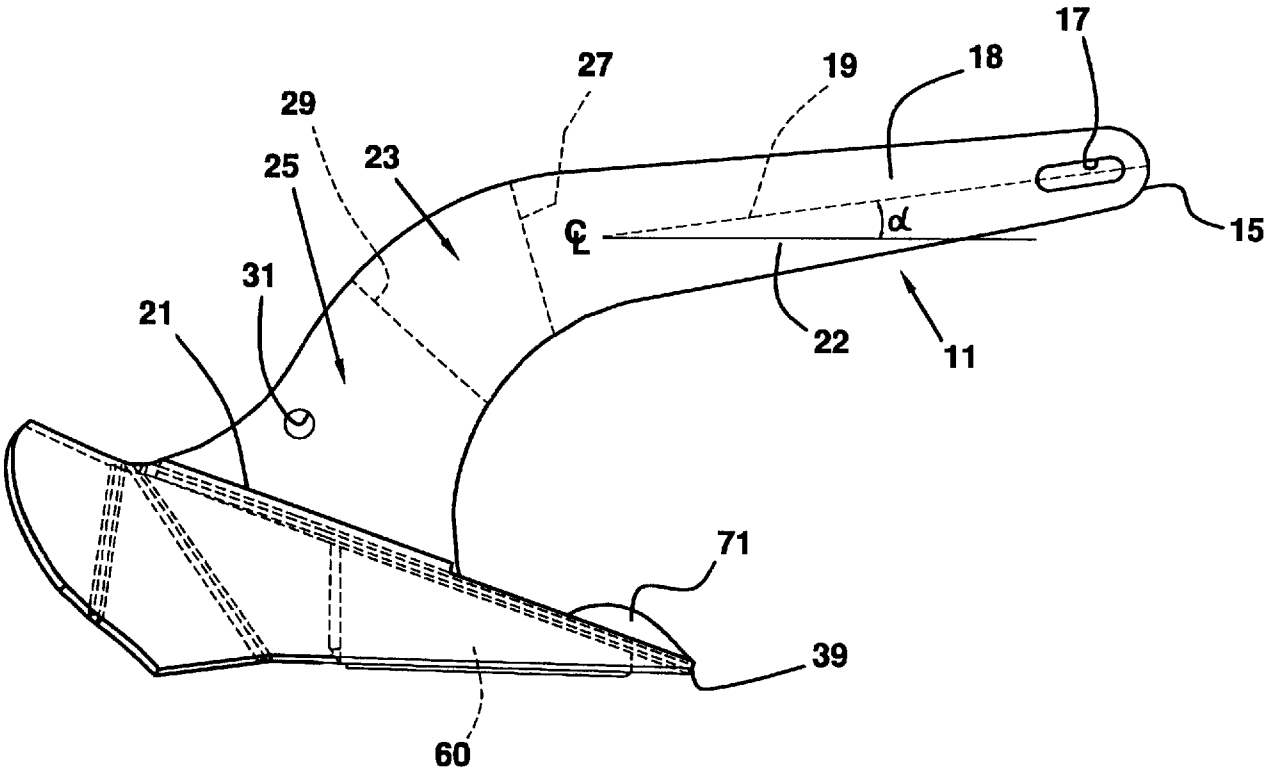
FIG. 6 shows a side view similar to that of FIG. 4 but with certain hidden portions shown in phantom.

As best seen in FIG. 6, the shank 11 extends from the forward end 15 thereof in the rearward direction, first in a straight line along the centerline 19 and then curves downwardly to a line of attachment 21 along the central axis 23 (FIG. 3) of the fluke 13.

As seen in FIG. 6, in the preferred embodiment, the shank 11 has a height or vertical dimension that is at its least adjacent the forward end 15 and widens in the rearward direction along the centerline 19, further widening at the curved section 23 and at the connecting section 25. In FIG. 6, the dashed lines 27 and 29 are merely shown to designate the transition points between the various sections of the shank 11 including the dashed line 27 that defines the transition between the straight forward section 18 and the curved section 23 and the dashed line 29 that defines the transition between the curved section 23 and the connecting section 25.

As best seen in FIG. 6, the connecting section 25 of the shank 11 includes an opening 31 therethrough to which may be attached a line (not shown) connected to a float (not shown) that allows a visual indication of the location where the anchor has set, as disclosed by Patentee Kershner in U.S. Pat. No. 5,188,055.

The fluke 13 is attached to the shank 11 at the linear connection 21. As best seen in FIG. 1, a weld bead 33 may be employed to fixedly secure the shank 11 to the fluke 13.

Figure 3:
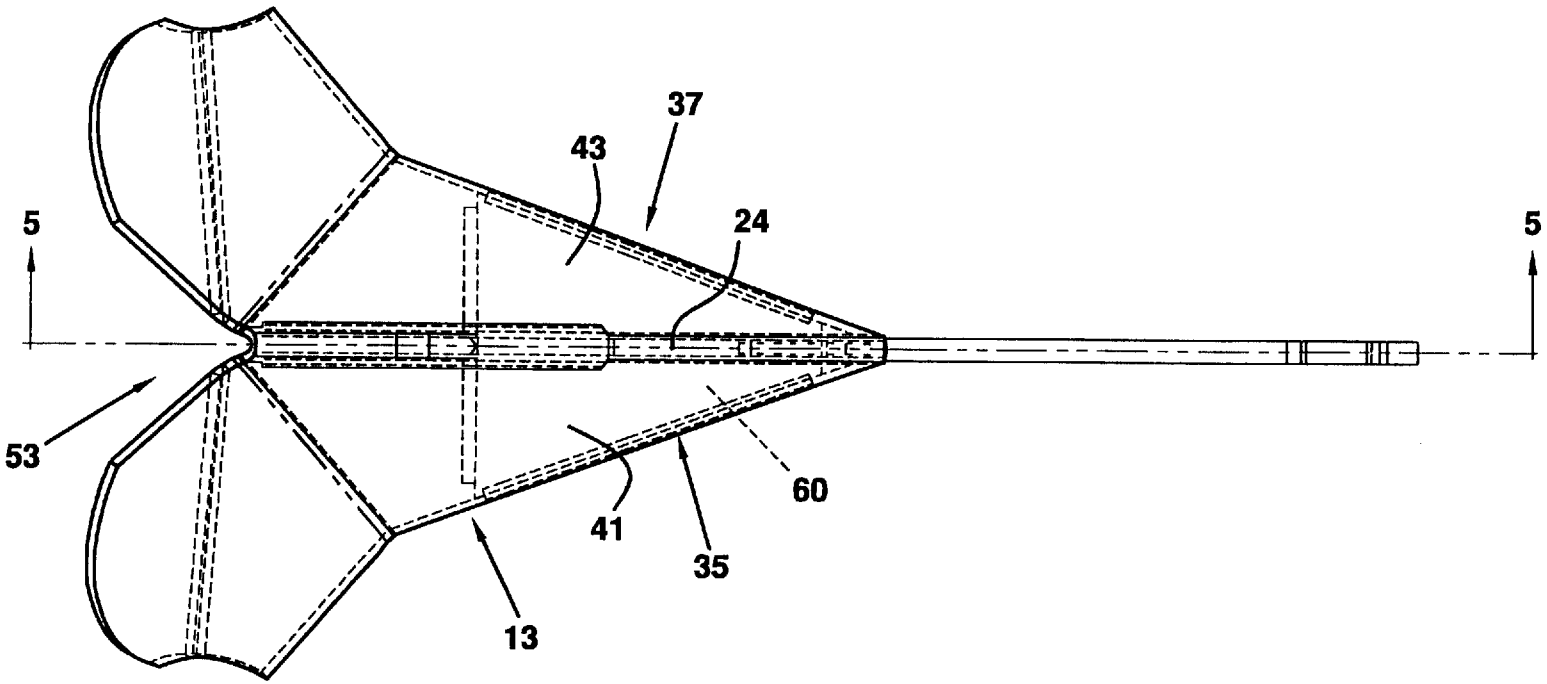
FIG. 3 shows a top view thereof.

With reference to FIG. 3, it is seen that the fluke 13 includes fluke halves 35 and 37 that are symmetric about the centerline 24 of the fluke 13. As best seen in FIG. 1, the fluke 13 includes a forward point 39 and two generally triangular plates 41 and 43 extending rearwardly therefrom. Rearward of the plate 41 are two plates 45 and 47 that combine together to provide a parabolic shape. Correspondingly, rearward of the plate 43 are plates 49 and 51 that form a parabolic shape. A V-shaped groove 53 extends rearwardly diverging from the connection line 21 between the shank 11 and the fluke 13 as best seen in FIG. 3.

Figure 2:
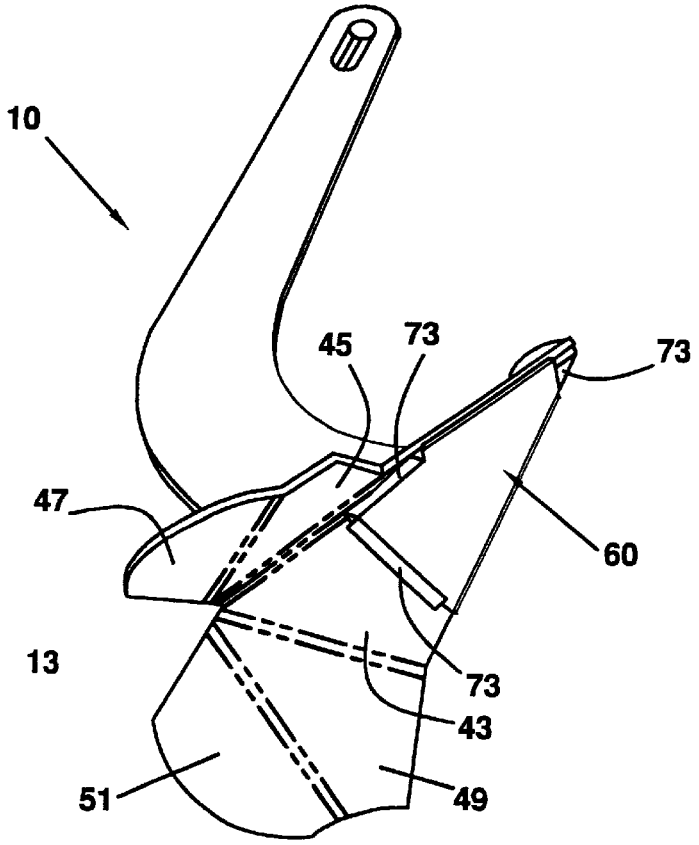
FIG. 2 shows a bottom perspective view of the present invention.
Figure 5:
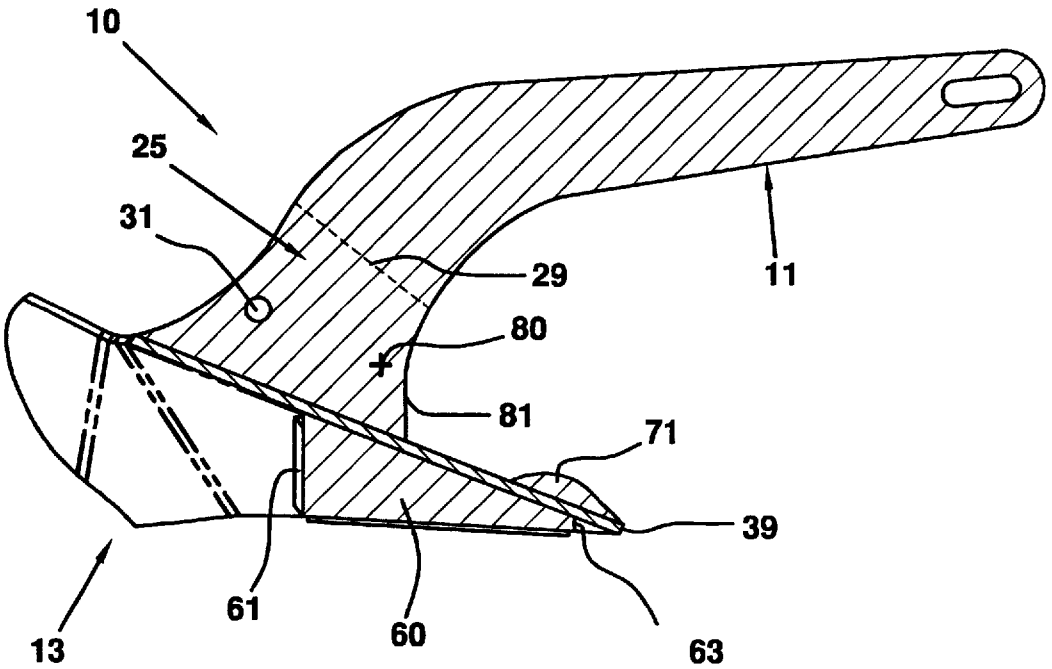
FIG. 5 shows a cross-sectional view along the line 5—5 of FIG. 3.

As seen in FIG. 2, the underside of the fluke 13 includes a recess, the forward end of which receives a nose weight 60 that is also seen in phantom in FIGS. 3 and 6 and in cross-section in FIG. 5. As best seen in FIG. 5, the nose weight 60 has a rearward extent 61 and extends forward to a forward extent 63 just rearward of the tip 39 of the fluke 13.

With reference to FIG. 1, in the preferred embodiment of the present invention, a slot 70 is provided at the forward end of the fluke 13 extending rearward from the tip 39 a desired distance as shown. Integrally formed with the nose weight is a spike or fin 71 that fits within the slot 70 and extends upwardly therefrom in the manner shown in the drawings. As seen in FIG. 2, weld beads 73 are employed to weld the nose weight 60 into the assembled position shown in the figures. An additional weld bead 75 may be provided to each side of the spike or fin 71 from above the axis 24 of the fluke 13.

While the spike or fin 71 has been described as being made integral with the nose weight 60, if desired, the spike or fin 71 may be made as a separate structure assembled to the anchor 10 in the manner shown in the drawing figures.

Figure 4:
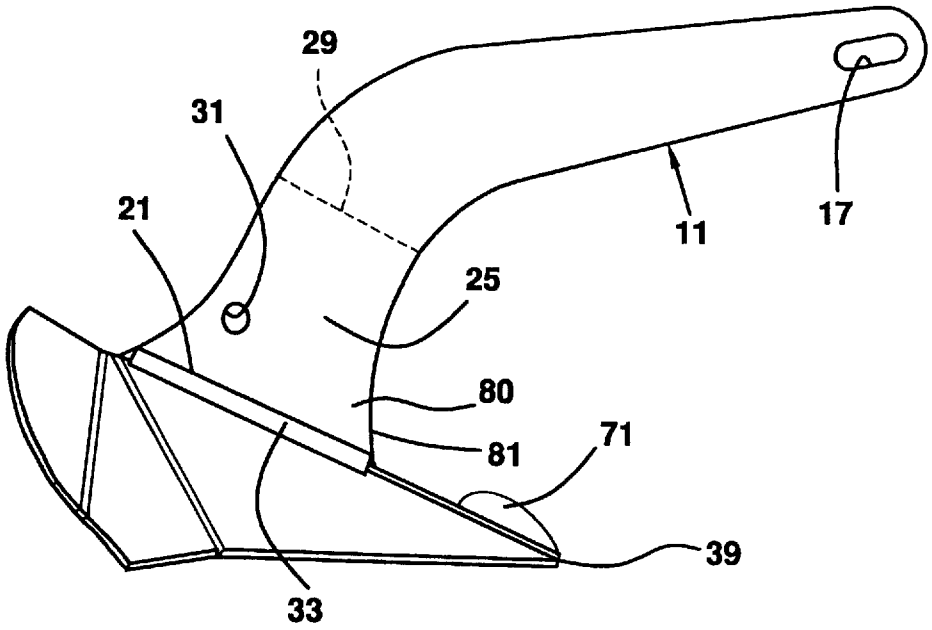
FIG. 4 shows a side view thereof.

With reference to FIGS. 4 and 5, the center of gravity of the inventive anchor 10 is designated by the reference numeral 80 and is seen to be located in the connecting section 25 of the shank rearward of the forward edge 81 thereof. As explained above, the center of gravity 80 is located in the connecting section 25 of the shank 11 in the position shown because, in that location, when force is applied to the shank 11 at the connection slot 17 in the forward direction, location of the center of gravity 80 at the position shown creates an overturning movement in the clockwise direction in the view of FIGS. 4, 5 and 6, thereby causing the forward point 39 of the fluke 13 to be angled downwardly into the sea bed to enhance the digging characteristics of the anchor as the anchor is moved in the forward direction. As the anchor digs itself into the sea bed, the spike or fin 71 digs into the sea bed immediately and acts as a guide to maintain linear movement of the anchor as it digs itself into the sea bed.

With reference to FIG. 6, in the preferred embodiment of the present invention, the angle $\alpha$ between the centerline 19 of the portion 18 of the shank 11 and a horizontal line 22 is about 7.5°. An angle within this approximate range improves the function of the anchor since it encourages the digging in of the nose 39 of the fluke 13 into the sea bed.

Applicant has performed trials on test anchors made in accordance with the teachings of the present invention. In these trials, Applicant has found that the inventive anchor, when deployed, buries itself within the sea bed within a distance approximating the length of the anchor. Such performance is a great advance over the prior art wherein anchors usually must travel several feet or more before they are completely buried.

In the preferred embodiment, as seen in FIGS. 1 and 3, the horizontal thickness of the shank 13 may be made extremely broad to enable the anchor to sit in a typical bow roller in a secure fashion when stowed. Furthermore, the connection line 21 between the shank 11 and the fluke 13 is intentionally made extremely long, in the range of ⅔ of the length of the fluke 13 so as to provide enhanced rigidity to the anchor structure as a whole.

With reference to FIG. 2, many plow-type anchors employ a stabilizing bar or rod between the portions 47 and 51 thereof to enhance stability. Applicant has found that such a stabilizing bar or rod detracts from the performance of the anchor because it deters the anchor from properly burying itself in the sea bed. Accordingly, Applicant has intentionally omitted such structure from his anchor.

As also seen in FIG. 6, the total length of the shank 11 from the forward termination 15 to the connection line 21 is almost twice the length of the fluke 13. This length dimension improves the efficiency of the burying capabilities of the inventive anchor by providing a lengthy lever arm allowing easier pivoting of the forward tip 39 of the anchor to facilitate burying of same.

In the preferred embodiment, the present invention may be made from any suitable manner such as, for example, galvanized steel, stainless steel, or any other such material.

As such, an invention has been disclosed in terms of a preferred embodiment thereof which fulfills each and every one of the objects of the invention as set forth hereinabove and provides a new and useful improved fixed shank plow anchor of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. An improved anchor, comprising:

a) a shank having a forward termination connectable to an anchor rode and a rearward termination fixedly connected to a double-bladed ploughshare-type fluke;

b) said shank having a straight forward section connected to a connecting section via a curved section, said connecting section including said rearward termination;

c) said fluke having a forward pointed end with a top edge and rear surfaces extending in a rearward direction therefrom and diverging laterally in said rearward direction and then converging in the rearward direction with respect to a centerline of said fluke, said rear surfaces defining a rearward extent of said anchor, said fluke having a flat bottom surface extending rearward from said forward pointed end and devoid of any downwardly extending projections;

d) a fin extending upwardly adjacent said forward pointed end, said fin extending upwardly from a lower terminus at said top edge of said forward pointed end; and e) a center of gravity of said anchor being located within said connecting section of said shank.

2. The anchor of claim 1, wherein said shank has a vertical dimension that increases in a direction from said forward termination toward said rearward termination.

3. The anchor of claim 1, wherein said fluke includes an undersurface defining a chamber open in a downward direction and a weight located in said chamber.

4. The anchor of claim 3, wherein said fin is formed integrally with said weight.

5. The anchor of claim 4, wherein said pointed end has a slot therethrough, said fin being received in said slot.

6. The anchor of claim 3, wherein said weight is sized and configured to fill said chamber, and further including a weld bead retaining said weight in said chamber.

7. The anchor of claim 1, wherein said center of gravity is located closer to a forward edge of said connecting section as compared to a rearward edge thereof.

8. An improved anchor, comprising:

a) a shank having a forward termination connectable to an anchor rode and a rearward termination fixedly connected to a fluke;

b) said fluke having a forward pointed end with a top edge and a flat bottom surface;

c) a fin extending solely upwardly adjacent said forward pointed end from a lower terminus at said top edge; and d) said anchor having a center of gravity within said shank.

9. The anchor of claim 8, wherein said fluke comprises a double-bladed ploughshare fluke having rear surfaces defining a rearward extent of said anchor.

* * * * *